United States Patent [19]

Chikuma

[11] Patent Number: 4,568,870

[45] Date of Patent: Feb. 4, 1986

[54] PHASE CONTROL DEVICE

[76] Inventor: Toichi Chikuma, 11-9-703, Sendagaya 4 Chome, Shibuya-ku, Tokyo, Japan, 151

[21] Appl. No.: 575,850

[22] Filed: Feb. 1, 1984

[30] Foreign Application Priority Data

Nov. 9, 1983 [JP] Japan ..... 58-209235

[51] Int. Cl.[4] ..... G05F 24/02

[52] U.S. Cl. ..... 323/326; 315/DIG. 4; 323/324; 323/272

[58] Field of Search ..... 323/237, 243, 320, 324, 323/325, 326, 272; 315/DIG. 4, DIG. 5, 101, 102

[56] References Cited

U.S. PATENT DOCUMENTS 4,119,887 10/1978 Iyama et al. ..... 315/101

4,460,848 7/1984 Fähnrich ..... 315/101

*Primary Examiner*—Peter S. Wong

*Assistant Examiner*—Judson H. Jones

*Attorney, Agent, or Firm*—Wenderoth, Lind & Ponack

[57] ABSTRACT

A phase control device for regulating illumination of a fluorescent lamp means is disclosed, which includes a thyristor, an ignition circuit therefor and a delay circuit for providing a time delay of a predetermined period after a power switch of a driving circuit of the fluorescent lamp means is closed so that the ignition circuit is actuated to make the thyristor operative to thereby regulate the illumination thereof only after the fluorescent lamp means warms up sufficiently before the phase control therefor is introduced.

2 Claims, 14 Drawing Figures

Fig. 3(A)
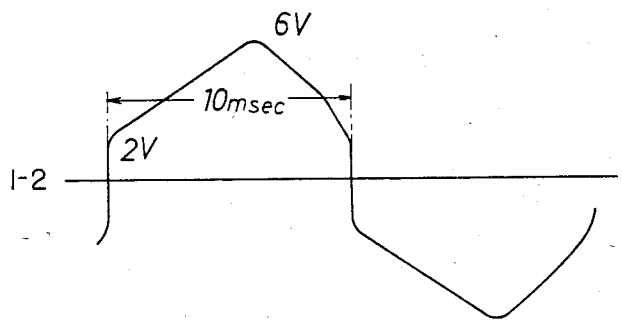
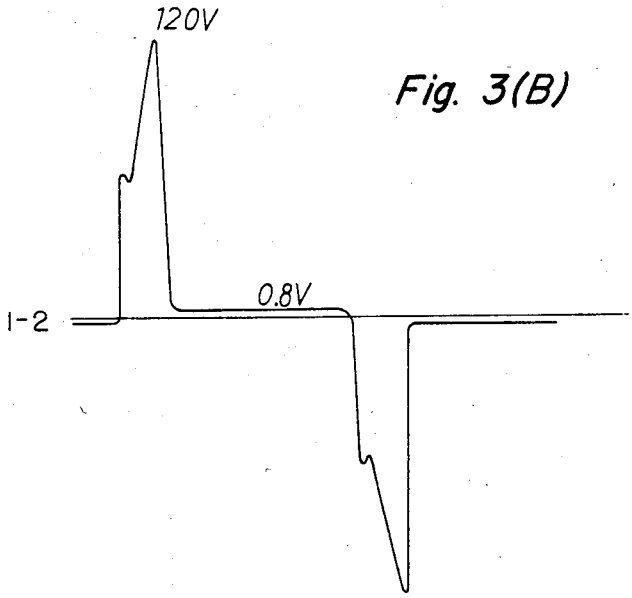
Fig. 3(B)

PHASE CONTROL DEVICE

BACKGROUND OF THE INVENTION

The present invention relates to a phase control device, and particularly, to a phase control device suitable to use in regulating an illumination of a fluorescent lamp.

An example of the conventional phase control device for illumination regulation of a fluorescent lamp is shown in FIG. 1. In FIG. 1, an anode of a thyristor 1 is connected to a gate of a triac 2 and a gate of the thyristor 1 is connected to a base of a unijunction transistor 3. An output pulse of the transistor 3 triggers the thyristor 1 and, during a conduction thereof, an a.c. voltage applied to a load 4 is phase-controlled by a gate current of the triac 2. A resistor 5 is selected such that a current flowing therethrough does not exceed a forward rate current of the thyristor 1, does not affect a gate characteristics of the triac 2 adversely and does not destroy a Zener diode 6. A variable resistor 7 is used for determining the degree of the phase-control. That is, a value of the variable resistor 7 is manually set to determine the phase angle after an ignition of the thyristor 1, to thereby regulate an illumination of the fluorescent lamp, i.e., the load 4 suitably.

This conventional phase control device, however, is relatively complicated in construction and is relatively not stable because the phase control is conducted simultaneously with a turning-on of the lamp 4 which requires a certain time enough to warm up a hot cathode thereof.

SUMMARY OF THE INVENTION

An object of the present invention is to provide a phase control device for use in illumination regulation of a fluorescent lamp, which is much simpler in construction than the conventional device and capable of providing a stable automatic phase control.

According to the present invention, the above object is achieved by a phase control device comprising a full-wave rectifier for rectifying an a.c. source voltage, a thyristor connected to the rectifier, a thyristor igniting circuit connected in parallel to the thyristor, the thyristor igniting circuit including a first, a second and a third igniting resistors connected in series, a junction between the second and the third igniting resistors being connected to a gate of the thyristor, a capacitor adapted to be charged by a full-wave rectified voltage when the thyristor is ignited, a resistor connected to the capacitor, a transistor adapted to be turned on by a voltage applied through the resistor from the charged capacitor, and a delay circuit for connecting the transistor to a junction between the first and second igniting resistors to supply an output current of the transistor to the thyristor igniting circuit, whereby the phase control is started at a predetermined time after a power switch is closed so that a temperature of a hot cathode of a fluorescent lamp which acts as a thermoelectron source is allowed the rise to a value enough to start a luminescence of the lamp and stabilize it to thereby improve a life characteristics of the lamp.

Another object of the present invention is to provide a phase control device in which a single on-off switch is used to switch a power as well as to select an operation mode of the phase control device.

According to the present invention, the above object is achieved by adding, to the above mentioned device, a mode switching thyristor connected to the rectifier, an igniting circuit connected in parallel to the mode switching thyristor for igniting the latter and a timer circuit connected to the mode switching thyristor and the igniting circuit therefor, the timer circuit being energized by a current flowing through the thyristor, when the thyristor is ignited by the igniting circuit, for short-circuiting the latter circuit to maintain the thyristor conductive and, when thyristor is turned off, for holding the short-circuit condition of the igniting circuit for a predetermined period of time to keep the thyristor inoperative for the predetermined period.

BRIEF DESCRIPTION OF THE DRAWING

FIGS. 3A to 3B and 4A to 4C are voltage waveforms at various points of the circuit in FIG. 2, respectively;

DETAILED DESCRIPTION OF PREFERRED EMBODIMENTS

Figure 1:
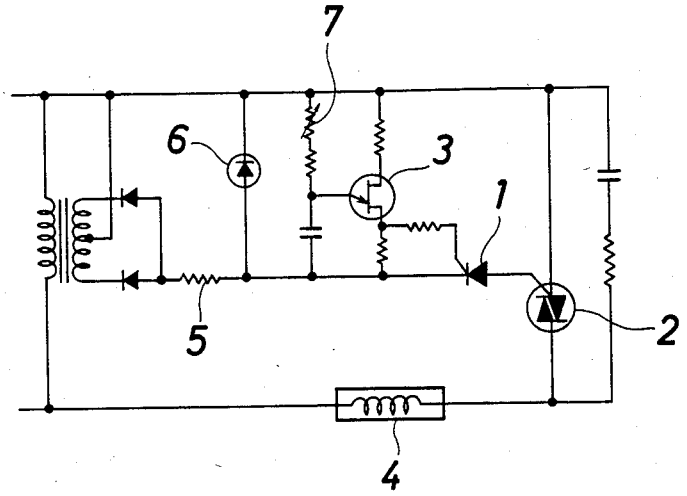
Fig. 1 PRIOR ART
FIG. 1 is a circuit diagram of a typical example of the conventional phase control device.
Figure 2:
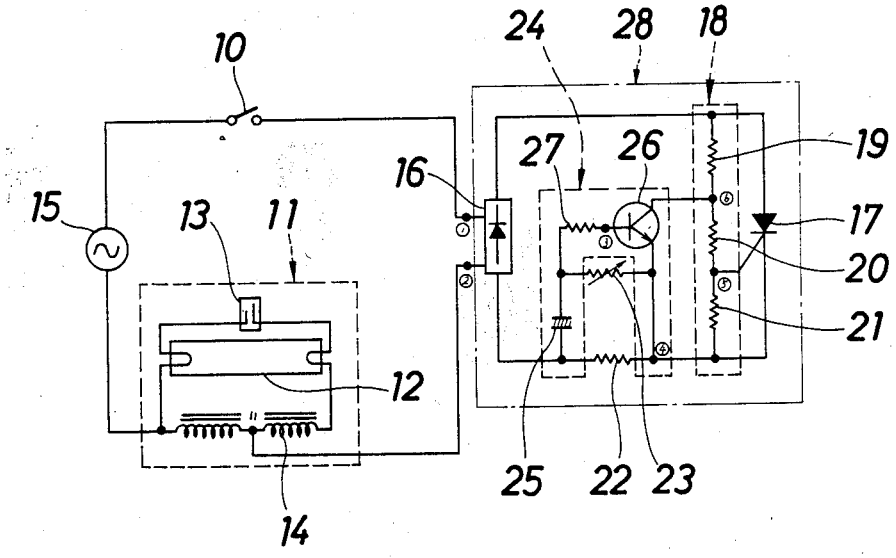
FIG. 2 is a circuit diagram of an embodiment of the present invention.

In FIG. 2 which shows an embodiment of the present invention, a phase control portion 28 of the present invention is arranged in between a power switch 10 and a fluorescent lamp 11 as shown by a chain line. The fluorescent lamp 11 is constituted with a fluorescent tube 12, a glow starter 13 and a stabilizer 14 and fluoresces when an a.c. voltage (e.g. 100 V) is applied from an a.c. power source 15 by closing the power switch 10.

The present device includes a full-wave rectifier 16 connected to the a.c. power source 15 to convert the a.c. voltage to a d.c. voltage. A thyristor 17 and an igniting circuit 18 therefor is connected in parallel to the full-wave rectifier 16. The igniting circuit 18 comprises a series circuit of a first, a second and a third igniting resistors 19, 20 and 21. An end of the first igniting resistor 19 is connected to an anode of the thyristor 17 and an end of the third igniting resistor 21 is connected to a cathode of the same thyristor. A junction between the second and third igniting resistors 20 and 21 is connected to a gate of the thyristor 17. A resistor 22 is connected between the cathode of the thyristor 17 and one of the output terminals of the full-wave rectifier 16 and a series circuit of a variable resistor 23 of high resistance and a capacitor 25 is connected in parallel to the resistor 22.

The present device further includes a delay circuit 24 which is constituted with the capacitor 25, a transistor 26 and a resistor 27 connected between a base of the transistor 26 and the capacitor 25. A collector of the transistor 26 is connected to a junction between the first and the second igniting resistors 19 and 20 of the igniting circuit 18 and an emitter thereof is connected to the cathode of the thyristor 17.

In operation, when the power switch 10 is closed, a sinusoidal a.c. voltage is applied from the power source 15 to the full-wave rectifier 16 and a d.c. voltage across the output terminals of the rectifier 16 is applied across the igniting circuit 18 so that the thyristor 17 is ignited. On the other hand, an a.c. voltage which is slightly reduced in value from the source voltage due to a small voltage drop across the present device is applied to the fluorescent lamp 11 by which the glow starter 13 thereof is actuated.

Further, with the thyristor 17 ignited, a full-wave rectified current flows through the resistor 22, producing a voltage drop thereacross. The capacitor 25 is charged gradually by this voltage drop and when the charge voltage of the capacitor 25 exceeds a predetermined value, the transistor 26 is turned on. An output current of the transistor 26 is added to the current flowing through the igniting circuit 18 and a portion of the composite current is supplied to the gate of the thyristor 17. Therefore, the ignition angle thereof is changed and thus the anode current is changed, resulting in a phase control of the a.c. voltage.

Thus, an output light intensity of the fluorescent lamp 11 is reduced due to the phase-controlled a.c. voltage and a regulation of light intensity is therefore realized.

That is, the a.c. voltage related to the phase control is not applied to the fluorescent lamp 11 when the power switch 10 is closed and, instead thereof, a sinusoidal a.c. voltage is applied thereto. After a predetermined period of time (T1) from the closure of the switch, the voltage for phase control is applied thereto. Therefore, the light intensity of the fluorescent lamp 11 can be regulated after the glow starter 13 is actuated and the fluorescent lamp 11 is lit. The time T1 can be regulated by regulating the variable resistor 23.

It has been found that a stable phase control can be obtained for a 100 V, 40 W fluorescent lamp with using the present device having the following conditions:

| | |
|---|---|
| resistor 19 | 90 Ω |
| resistor 20 | 1 KΩ |
| resistor 21 | 1 KΩ |
| resistor 22 | 2 KΩ |
| resistor 23 | 90 KΩ |
| resistor 27 | 2 Ω |
| resistor 25 | 100 μF |

Figure 4A:
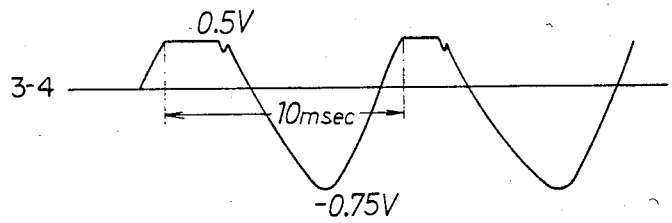
Figure 4B:
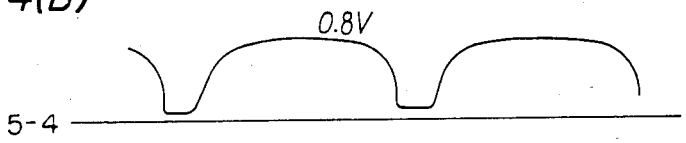
Figure 4C:
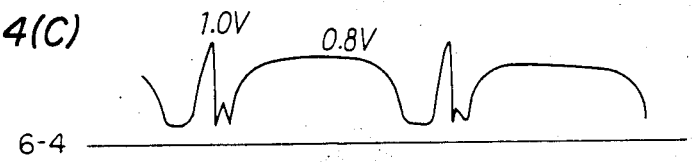

A waveform of a voltage across terminals 1 and 2, i.e., the voltages applied to the fluorescent lamp 11 are shown in FIGS. 3A and 3B. The voltage applied to the lamp has the waveform shown in FIG. 3A during a time period of about 8 seconds after the closure of the power switch 10, i.e., the time period required to turn on the transistor 26 of the delay circuit 24 after the closure of the power switch, and the waveform is changed to that shown in FIG. 3B immediately after the time period of about 8 seconds, which is maintained thereafter. FIGS. 4A, 4B and 4C show voltage waveforms across terminals 3 and 4, 5 and 4 and 6 and 4 after the time period, respectively.

The illumination of the fluorescent lamp after the 8 seconds period becomes about a half of that in the initial stage. However, the reduction of illumination merely gives a slight feeling thereof while the quality of light becomes soft. Furthermore, the power factor is increased from 0.73 in the initial stage to 0.88 and the power consumption is reduced from 48 W to 24 W.

Figure 5:
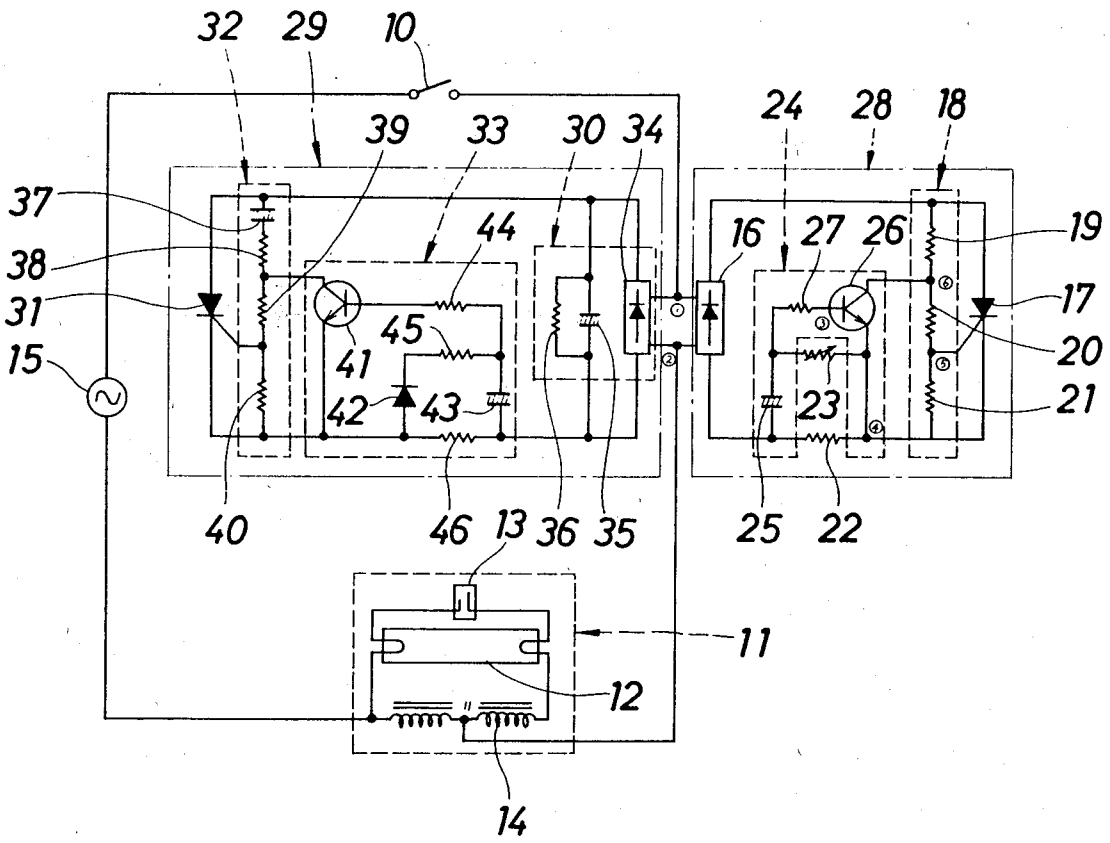
FIG. 5 is a circuit diagram of a second embodiment of the present invention.

Another embodiment of the present invention is shown in FIG. 5. A device shown in FIG. 5 includes, in addition to the construction of the first embodiment in FIG. 2, a mode switching portion 29 connected in parallel to the phase control portion 28. The mode switching portion 29 functions to provide a selection in operation between a phase control mode and a non-control mode.

The mode switching portion 29 includes a full-wave rectifier circuit 30, a thyristor 31, an ignition circuit 32 for the thyristor 31 and a timer circuit 33 for controlling the ignition circuit 32. The rectifier circuit 30 comprises a full-wave rectifier 34 and a parallel circuit of a capacitor 35 and a resistor 36. The parallel circuit is connected in parallel to the rectifier 34. The ignition circuit 32 comprises a series circuit of a capacitor 37, and resistors 38, 39 and 40. One end of the series circuit in the capacitor side is connected to an anode of the thyristor 31 and the other end thereof is connected to a cathode of the thyristor. A gate of the thyristor 31 is connected to a junction between the resistors 39 and 40. The timer circuit 33 comprises a transistor 41, a diode 42, a capacitor 43 and resistors 44, 45 and 46. One of electrodes of the capacitor 43 is connected through the resistor 46 to the cathode of the thyristor 31 and the other electrode thereof is connected through the resistor 45 and the diode 42 to the same cathode of the thyristor 31. A collector of the transistor 41 is connected to a junction between the resistors 38 and 39 of the ignition circuit 32, a base through the resistor 44 to the other electrode of the capacitor 43 and an emitter to the cathode of the thyristor 31.

In operation, when the power switch 10 is closed, a d.c. voltage is produced by the rectifier circuit 30 which is applied across the ignition circuit 32 to thereby ignite the thyristor 31. When the thyristor 31 is ignited and turned on and a current flows through an anode-cathode circuit of the thyristor, a voltage drop is produced across the resistor 46 of the timer circuit 33 to charge the capacitor 43 and the transistor 41 is turned on by a voltage of the capacitor thus charged. Consequently, the series circuit of the resistors 39 and 40 is short-circuited and thus the thyristor 31 is kept conductive. Therefore, the timer circuit 33 continues to operate as shown in FIG. 6.

When the power switch 10 is opened under this condition, the thyristor 31 is turned off. Since the transistor 43 of the timer circuit 31 continues to operate for a predetermined time T2 (e.g. 2–3 seconds) due to a residual charge on the capacitor 43, the ignition circuit 32 for the thyristor 31 is kept short-circuited for the time period T2. Therefore, the thyristor 31 is kept in the off state for the time T2 after the power switch 10 is opened.

Figure 6A:
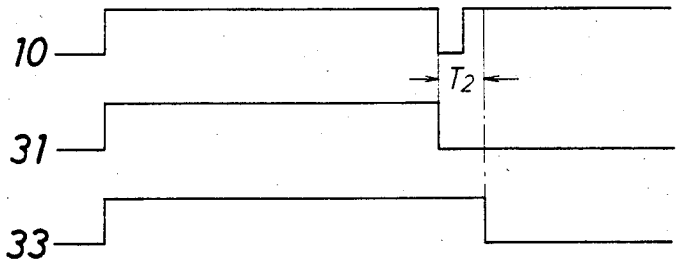
FIGS. 6A and 6B are time charts showing an operation of a mode switching portion of the second embodiment.
Figure 6B:
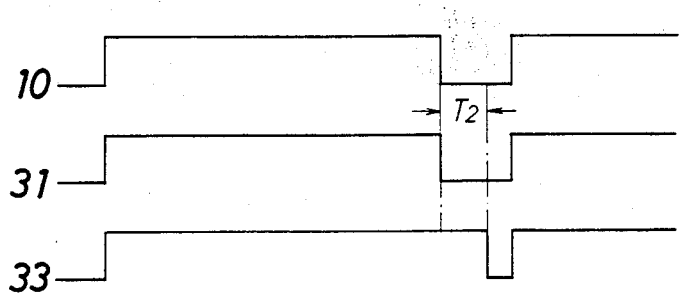

Therefore, even if the power switch 10 is closed again within the time period T2, the thyristor 31 can not be turned on, as shown in FIG. 6A. On the other hand, when the power switch 10 is closed after the time period T2, the thyristor 31 is turned on again since the operation of the timer 33 is terminated and the thyristor 31 is no more influenced thereby. At the same time, the timer circuit 33 becomes in operation again.

Therefore, when the power switch 10 is closed again within the time period T2 after the power switch is opened, the phase control portion 28 is not actuated because the thyristor 31 of the mode switching portion 29 is not caused to turn on, and thus the illumination regulation of the fluorescent lamp 11 such as described with reference to the first embodiment does not occur. On the other hand, when the power switch 10 is closed again after the time period T2 lapses from the opening of the switch, the thyristor 31 is turned on to thereby actuate the phase control portion 28. Therefore, a selection in operation of the fluorescent lamp between the phase control mode and the non-control mode can be made by merely selecting the timing of closure of the power switch 10 after the latter is once opened.

It has been found that when the constants of the circuit elements of the phase control portion 28 being the same as those mentioned previously, the constants of the circuit elements of the mode switching portion 29 are selected as below, a favorable result is obtained.

| | |
|---|---|
| capacitor 35 | 20 μF |
| resistor 36 | 10 KΩ |
| capacitor 37 | 2 μF |
| resistor 38 | 1 KΩ |
| resistor 39 | 500 Ω |
| resistor 40 | 1 KΩ |
| capacitor 43 | 47 μF |
| resistor 44 | 40 KΩ |
| resistor 45 | 40 KΩ |
| resistor 46 | 2 Ω |

Figure 7:
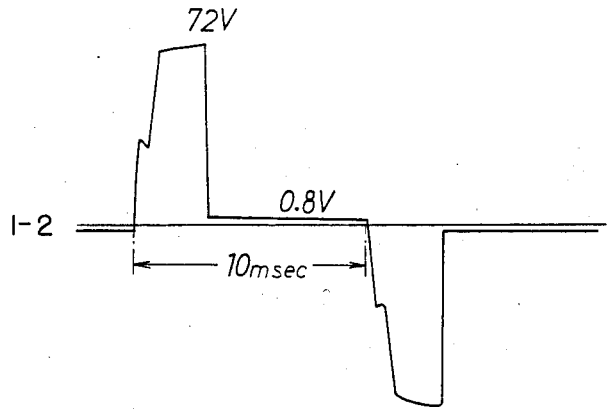
FIGS. 7 and 8A to 8C are voltage waveforms at various points of the circuit in FIG. 5, resepctively.
Figure 8A:
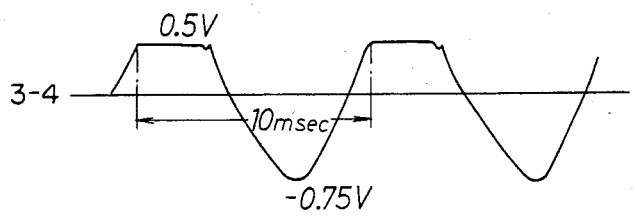
Figure 8B:
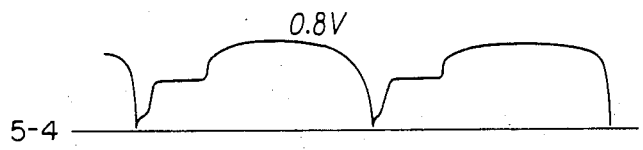
Figure 8C:
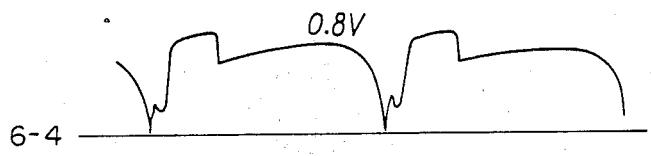

A voltage waveform across the terminals 1 and 2 is shown in FIG. 7 and voltage waveforms across terminals 3 and 4, 5 and 4 and 6 and 4 are shown in FIGS. 8A, 8B and 8C, respectively. As will be clear from a comparison of them with FIG. 3, the waveform across the terminals 1 and 2 in FIG. 7 is more stable that in the first embodiment shown in FIG. 3B.

It should be noted that although different rectifiers 16 and 34 are used for the phase control portion 28 and the mode switching portion 29 of the second embodiment, respectively, a single rectifier may be used commonly.

As mentioned hereinbefore, the present invention is much simpler in construction than the conventional phase control device which uses a unijunction transistor while providing a more stable automatic phase control. Further, since the phase control is performed not immediately after the closure of the power switch but after a predetermined time lapses from the closure thereof, it is possible to provide a time long enough to allow the hot cathode of the lamp to be heated to a desired temperature and kept thereat, to thereby improve the life time characteristics of the fluorescent lamp.

Furthermore, according to the present invention, the selection of operation mode between the phase control mode and the non-control mode can be performed by merely selecting the timing of closure of the power switch.

What is claimed is:

1. A phase control device comprising a full-wave rectifier, a first thyristor connected to an output terminal of said full-wave rectifier, a first ignitor circuit connected in parallel to said first thyristor for igniting the latter, said first ignitor circuit comprising a first, a second and a third igniting resistors connected in series, free ends of said first and third igniting resistors being connected to an anode and a cathode of said first thyristor, respectively, and a junction between said second and third igniting resistors being connected to a gate of said first thyristor and a delay circuit including a capacitor adapted to be charged with an output of said full-wave rectifier when said first thyristor is turned on, a resistor connected to said capacitor, and a transistor having a collector connected to a junction between said first and second igniting resistors and adapted to be turned on with a voltage on said capacitor applied through said resistor to a base thereof so that an output current of said transistor is added to a current flowing through said first ignitor circuit after a delay determined by a time constant of resistor and capacitor.

2. The phase control device as claimed in claim 1, further comprising a second thyristor connected to the output terminal of said full-wave rectifier, a second ignitor circuit connected in parallel to said second thyristor and a timer circuit connected to said second thyristor and said second ignitor circuit and adapted to be actuated by a current flowing through said second thyristor when said second thyristor is ignited by said second ignitor circuit to short-circuit said second ignitor circuit to thereby keep said second thyristor conductive and when said second thyristor is turned off to keep said second ignitor circuit short-circuited for a predetermined period of time after the turning off of said second thyristor to thereby keep said second thyristor non conductive for the predetermined period of time.

* * * * *